US008443866B2

(12) United States Patent
Goodman

(10) Patent No.: US 8,443,866 B2
(45) Date of Patent: May 21, 2013

(54) METHODS, APPARATUSES, AND SYSTEMS FOR MOVABLE PARTITIONS

(75) Inventor: E. Carl Goodman, Bountiful, UT (US)

(73) Assignee: Won-Door Corporation, Salt Lake City, UT (US)

( * ) Notice: Subject to any disclaimer, the term of this patent is extended or adjusted under 35 U.S.C. 154(b) by 93 days.

(21) Appl. No.: 12/838,235

(22) Filed: Jul. 16, 2010

(65) Prior Publication Data

US 2012/0012259 A1 Jan. 19, 2012

(51) Int. Cl.
*E06B 3/94* (2006.01)

(52) U.S. Cl.
USPC ..... 160/84.02; 160/1; 160/188

(58) Field of Classification Search
USPC ..... 160/84.02, 188, 1, 7, 199, 196.1, 160/201
See application file for complete search history.

(56) References Cited

U.S. PATENT DOCUMENTS 3,289,741 A * 12/1966 Gossling ..... 160/188
3,316,624 A 5/1967 Brudevold
4,133,364 A 1/1979 Smart
6,662,848 B2 * 12/2003 Goodman et al. ..... 160/84.02
7,066,297 B2 * 6/2006 Goodman et al. ..... 160/84.02
7,478,663 B2 * 1/2009 Goodman et al. ..... 160/188
7,513,293 B2 * 4/2009 Goodman et al. ..... 160/188
7,656,129 B2 2/2010 Banta et al.
7,845,385 B2 * 12/2010 Goodman et al. ..... 160/188
8,100,164 B2 * 1/2012 Goodman et al. ..... 160/199
2006/0144529 A1 * 7/2006 Hemphill ..... 160/188
2012/0012259 A1 * 1/2012 Goodman ..... 160/127

OTHER PUBLICATIONS

U.S. Appl. No. 12/542,448, filed Aug. 17, 2009, entitled Methods, Apparatuses, and Systems for Driving a Movable Partition.
U.S. Appl. No. 12/758,584, filed Apr. 12, 2010, entitled Methods, Apparatuses, and Systems for Movable Partitions.

* cited by examiner

*Primary Examiner* — Blair M. Johnson
(74) *Attorney, Agent, or Firm* — TraskBritt

(57) ABSTRACT

Movable partition systems include a movable partition coupled to and movable along a track. The movable partition may comprise at least two accordion folding sheets of panels, a motor carried by the movable partition, and at least one electronic component unit configured to control the motor. The electronic component unit may be carried by the movable partition and disposed between the sheets of folding panels. Methods of installing a movable partition system include coupling an electronic component box to a floating door jamb within a movable partition.

23 Claims, 7 Drawing Sheets

METHODS, APPARATUSES, AND SYSTEMS FOR MOVABLE PARTITIONS

TECHNICAL FIELD

Embodiments of the invention are directed to the field of movable partitions that may be used for one or more of partitioning space, providing sound barriers, providing fire barriers, providing security barriers, or for various other purposes.

BACKGROUND

Movable partitions are utilized in numerous situations and environments for a variety of purposes. Such partitions may include, for example, foldable or collapsible doors configured to enclose or subdivide a room or other area. Often such partitions are utilized simply to subdivide a single large room within a building into multiple smaller rooms. The subdivision of a larger space may be desired, for example, to accommodate multiple groups or meetings simultaneously. Such partitions also may be used for noise control depending, for example, on the activities taking place in a given room or portion thereof.

Movable partitions may also be used to provide a security barrier, a fire barrier, or both a security barrier and a fire barrier. In such cases, the movable partition may be configured to automatically close upon the occurrence of a predetermined event, such as the actuation of an associated alarm. For example, one or more accordion or similar folding-type partitions may be used as a security barrier, a fire barrier, or both a security barrier and a fire barrier, wherein each partition includes a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other specified reason, the partition may be extended along a track, which may be an overhead track located above the movable partition on or in a header assembly, until the partition extends a desired distance across the room.

When deployed, a leading end of the movable partition, which may include or be defined by a component known as a "lead post," complementarily engages another structure, such as a wall, a post, or a lead post of another door.

Automatic extension and retraction of the movable partition may be accomplished through the use of a motor located in the pocket formed in the wall of the building in which the movable partition is stored when in a retracted or folded state. The motor, which remains fixed in place within the pocket, may be used to drive extension and retraction of the movable partition. Controls for operating the motor and power supplies for supplying power to the motor and other electrical components are also located in the pocket formed in the wall of the building in which the movable partition is stored when in a retracted or folded state.

BRIEF SUMMARY

In some embodiments, the present invention includes movable partition systems comprising a movable partition that is coupled to and movable along a track. The movable partition may include at least two accordion folding sheets of panels. The systems may further include a motor carried by the movable partition and at least one electronic component unit comprising a power supply and a processor. The electronic component unit may be configured to control operation of the motor, and may be disposed between the at least two accordion folding sheets of panels and carried by the movable partition.

In additional embodiments, the present invention includes movable partition systems that include a track, a movable partition coupled to the track and extending longitudinally between a first end and a second end. The movable partition may include a first partition having a first end and a second end, a second partition having a first end and a second end, the second partition being laterally spaced from the first partition. The movable partition may further include a lead post coupled with the first end of the first partition and the first end of the second partition, and a floating door jamb coupled with the second end of the first partition and the second end of the second partition. The systems may further include a first processor disposed between the first partition and the second partition proximate the lead post, an electronic component box disposed between the first partition and the second partition proximate the floating door jamb, and a motor carried by the movable partition and configured to drive movement of the movable partition along the track. The electronic component box may include a second processor and a battery-backed power supply.

In additional embodiments, the present invention includes methods of installing a movable partition system. In accordance with such methods, at least one track is attached to an overhead structure of a building such that the at least one track extends across a space within the building. A movable partition is suspended from the track. The movable partition may include a first partition and a second partition each extending between a leading end and a floating door jamb. A drive system is coupled to the movable partition between the first partition and the second partition. The drive system may be configured to move the movable partition along the at least one track. A first processor may be coupled to the movable partition between the first partition and the second partition proximate the leading end of the movable partition. An electronic component box may be coupled to the floating door jamb of the movable partition between the first partition and the second partition.

BRIEF DESCRIPTION OF THE SEVERAL VIEWS OF THE DRAWINGS

While the specification concludes with claims particularly pointing out and distinctly claiming what are regarded as embodiments of the invention, the advantages of embodiments of the invention may be more readily ascertained from the description of example embodiments of the invention when read in conjunction with the accompanying drawings, in which:

DETAILED DESCRIPTION

Illustrations presented herein are not meant to be actual views of any particular movable partition system or component of a movable partition system, but are merely idealized representations that are employed to describe example embodiments of the present invention. Additionally, elements common between figures may retain the same numerical designation.

Figure 1:
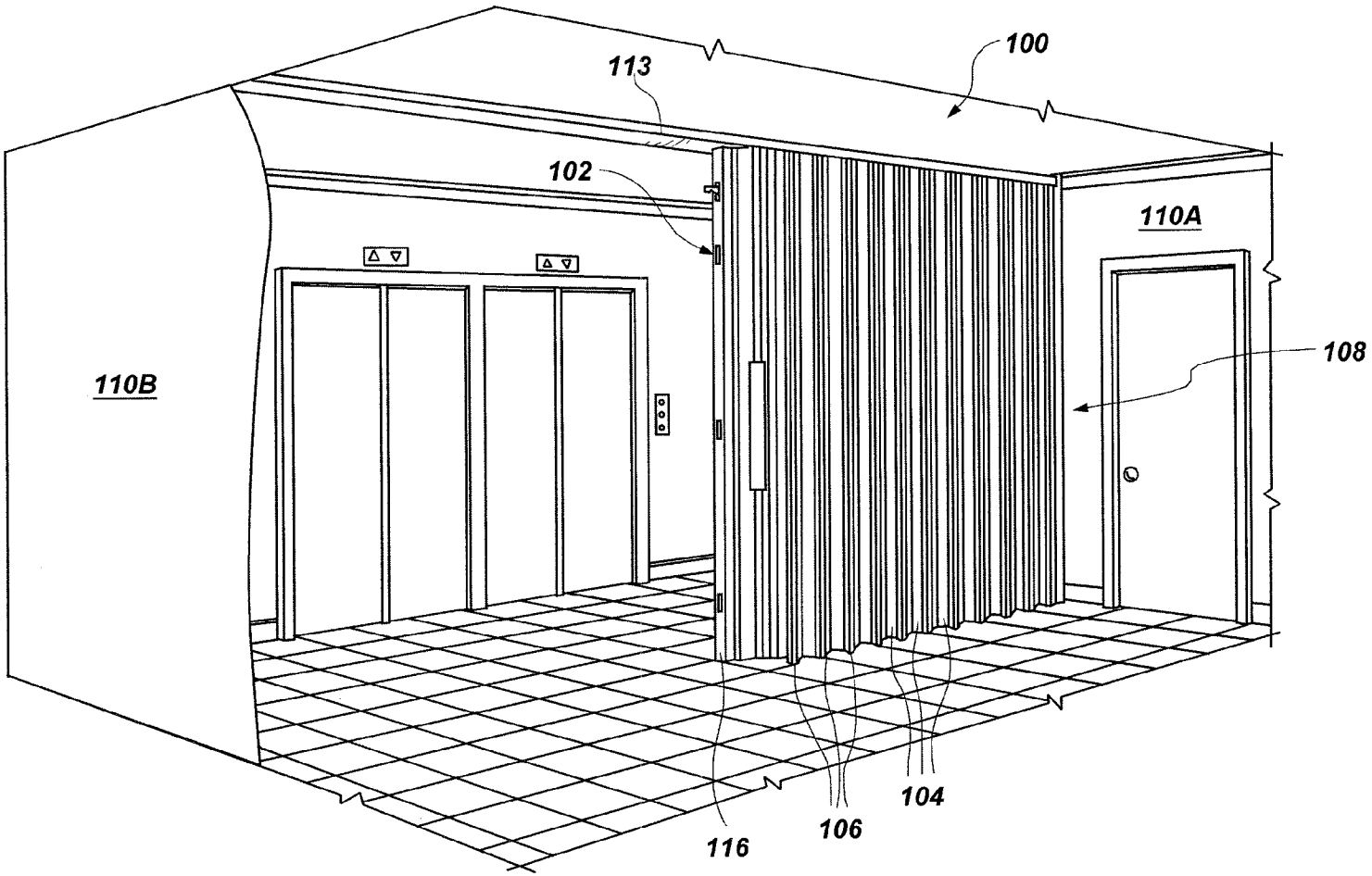
FIG. 1 is a perspective view of an embodiment of a movable partition system of the present invention.

FIG. 1 illustrates an embodiment of a movable partition system 100 of the present invention. The movable partition system 100 may be an automatic movable partition system, in that the system 100 includes a movable partition 102 that may be automatically extended, automatically retracted, or both automatically extended and automatically retracted. As discussed in further detail below, the movable partition 102 also may be manually extended, manually retracted, or both manually extended and manually retracted. In other words, the movable partition system 100 may be moved both automatically and manually, as desirable. The movable partition 102 may be used for partitioning space, as a sound barrier, as a fire barrier, as a security barrier, for combinations of such purposes, or for other purposes.

The movable partition 102 may comprise, for example, an accordion-type door, as shown in FIG. 1. The movable partition 102 may be formed with a plurality of panels 104 that are connected to one another with hinges or other hinge-like members 106. The hinged connection of the panels 104 allows the panels 104 to fold, and the movable partition 102 to collapse, in accordion style, as the movable partition 102 is retracted, which allows the movable partition 102 to be compactly stored in a pocket 108 formed in a wall 110A of a building when in a retracted or folded state. In other embodiments, the movable partition 102 may comprise a sliding door, or another type of movable partition 102.

When it is desired to deploy the movable partition 102 to an extended position, the movable partition 102 is driven along a track assembly or track 113 across the space to provide an appropriate barrier. The track 113 may comprise an overhead track, in some embodiments.

Figure 2:
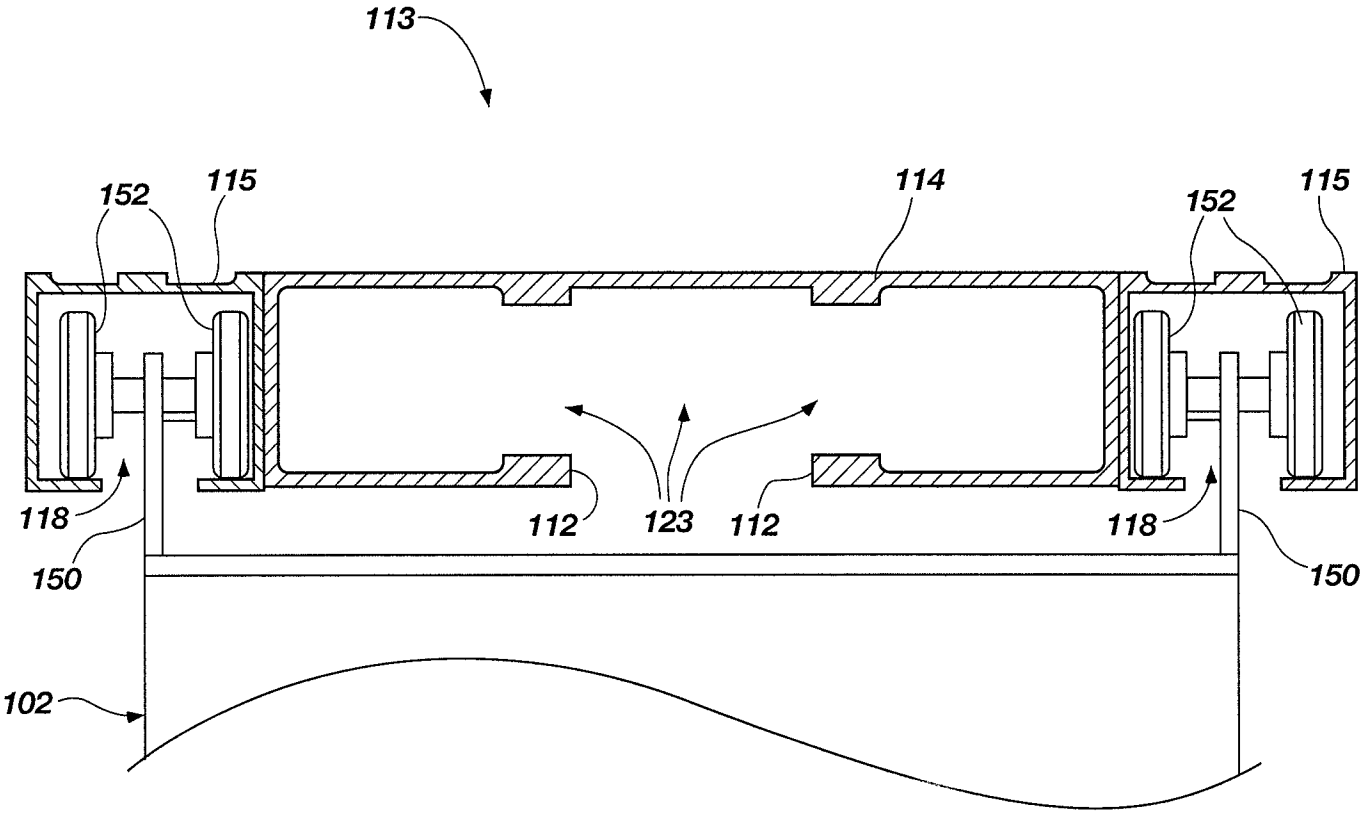
FIG. 2 is a partial cross-sectional view of a support system of the movable partition system of FIG. 1.

Referring to FIG. 2, one embodiment of the track assembly or track 113 may include an elongated central guide member 114, and two elongated lateral guide members 115 disposed on opposite lateral sides of the elongated central guide member 114. In some embodiments, the central guide member 114 and lateral guide members 115 may comprise separate bodies or structures that are attached to one another, or simply installed proximate one another. In additional embodiments, the central guide member 114 and lateral guide members 115 may comprise different regions of a single, unitary body or structure.

The central guide member 114 may comprise a hollow body having internal surfaces defining a channel 123 that extends longitudinally through the central guide member 114. The channel 123, also referred to as an internal channel, defined by central guide member 114 may be used to at least partially house rollers (e.g., wheels), drive mechanism components, etc., of the movable partition system 100, as described in further detail below.

Each of the lateral guide members 115 also may comprise a hollow body having internal surfaces defining channels 118 that extend longitudinally through the lateral guide members 115, respectively. The movable partition 102 may be suspended from (i.e., hang from) partition support members 150 and move along the track 113 by the rolling of partition support rollers 152 (e.g., wheels) within and along the channels 118 that extend longitudinally through the lateral guide members 115 of the track 113. The rollers 152 may be coupled to partition support members 150 and the movable partition 102 may be attached to and suspended from the partition support members 150.

Figure 3:
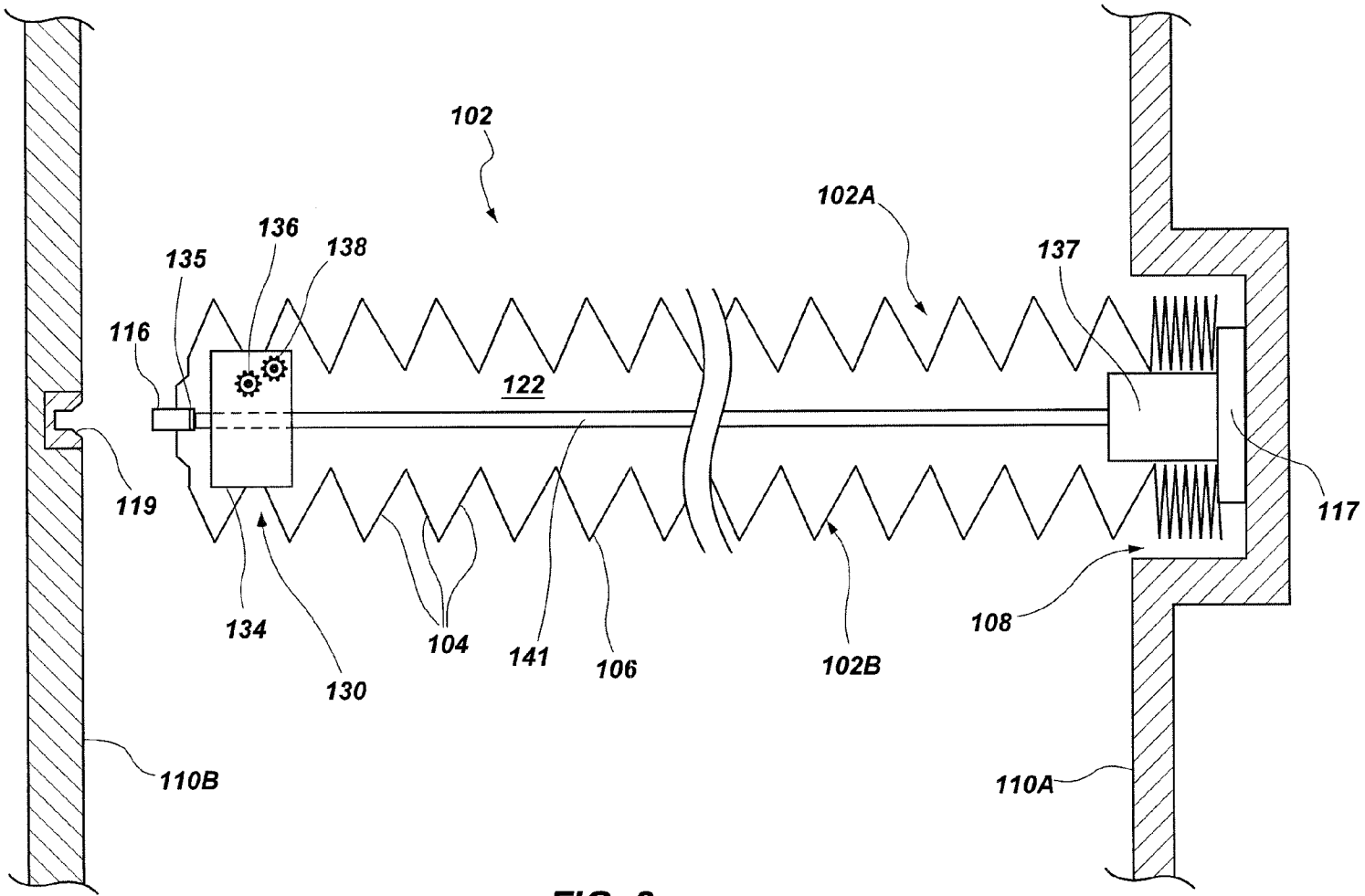
FIG. 3 is a simplified top view illustrating the movable partition and some components of a drive system including a first processor and an electronic component box of the movable partition system of FIG. 1.

Referring now to FIG. 3, a leading end of the movable partition 102, which may comprise a male lead post 116, may be configured to matingly (i.e., complementarily) engage with a jamb or door post 119 that may be formed in another wall 110B of a building when the movable partition 102 is in a deployed or an extended state. In other embodiments, the male lead post 116 may also matingly engage with a female lead post (not shown) of another movable partition (not shown), which may also be suspended from the track 113. Such an additional movable partition with the female lead post (not shown) may also be configured to move automatically and/or manually.

As shown in FIG. 3, an accordion-type movable partition 102 may include a first sheet 102A of panels 104 and a second sheet 102B of panels 104 that is laterally spaced from the first sheet 102A of panels 104. The leading ends of the first sheet 102A and the second sheet 102B may be attached at or near the lead post 116. Such a configuration may be used as a fire door, wherein the first sheet 102A acts as a primary fire and smoke barrier, the space 122 between the first sheet 102A and the second sheet 102B acts as an insulator or a buffer zone, and the second sheet 102B acts as a secondary fire and smoke barrier. Such a configuration may also be useful in providing an acoustical barrier when the movable partition 102 is used to subdivide a larger space into multiple rooms.

As further shown in FIG. 3, an automatic drive system 130, a first electronic signal processor 135 (which may be or include a microprocessor), and an electronic component box 137 may be disposed within the space 122 between the first sheet 102A and the second sheet 102B, and may be carried by the movable partition 102. As shown in FIG. 3, all of the drive and control components of the movable partition 102 may be confined between the first sheet 102A and the second sheet 102B of the movable partition 102, and may be attached to and carried by the movable partition 102.

The drive system 130 may be positioned near the lead post 116 of the movable partition 102. The drive system 130 may include a motor carried by the movable partition 102 as described in detail in U.S. patent application Ser. No. 12/542,448 which was filed Aug. 17, 2009 and entitled "Methods, Apparatuses, and Systems for Driving a Movable Partition," and U.S. patent application Ser. No. 12/758,584, which was filed Apr. 12, 2010 , now U.S. Pat. No. 8,365,796, issued Feb. 5, 2013, and is entitled "Methods, Apparatuses, and Systems for Movable Partitions," the disclosure of each of which application is incorporated herein in its entirety by this reference. Briefly, the automatic drive system 130 may be configured to automatically open, automatically close, or to both automatically open and automatically close the movable partition 102 upon actuation thereof. The drive system 130 may include an elongated drive member (not shown), which, in some embodiments, may comprise, for example, a chain, belt, cable or rope having fixed ends. A rotatable drive member 136, such as a pulley, wheel, cog or sprocket, as shown, may be configured to engage the elongated drive member such that when the rotatable drive member 136 is rotated, the rotatable drive member 136 moves along the elongated drive member causing the movable partition 102 to automatically open or automatically close. In some embodiments, one or more rotatable idlers 138 may also be configured to engage the elongated drive member to provide at least one of proper tension, alignment, and engagement of the elongated drive member with the rotatable drive member 136.

Figure 4:
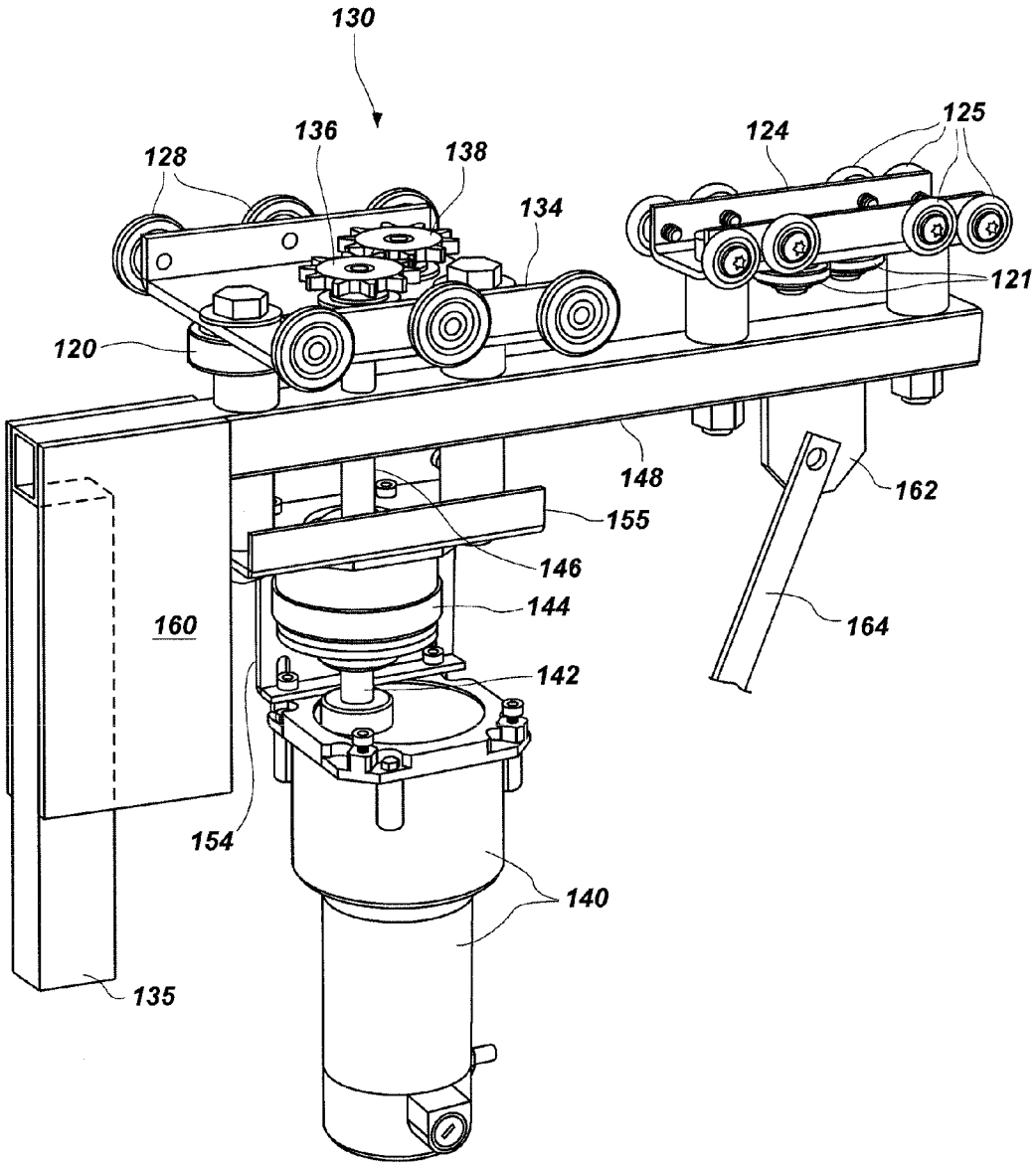
FIG. 4 is a perspective view illustrating components of the drive system, the support system and the first processor of the movable partition system of FIG. 1.

Referring to FIG. 4 in conjunction with FIG. 3, the drive system 130 may include a drive trolley 134, which may be disposed at least partially within the channel 123 (FIG. 2) extending longitudinally through the elongated central guide member 114, near the leading end of the movable partition 102. The drive trolley 134 may include drive trolley rollers 128 (e.g., wheels) and may be configured to roll along the track 113 at least partially within the channel 123 extending longitudinally through the elongated central guide member 114. The drive system 130 may also include a motor 140 and a clutch 144, which may be located in the space 122 between the first sheet 102A and the second sheet 102B. The motor 140 and the clutch 144 may be operatively connected, such that a drive shaft 142 of the motor 140 drives the rotation of a drive shaft 146 or output of the clutch 144 when the clutch 144 is in an engaged state. The drive system 130 may further include a rotatable drive member 136 that is operatively connected to the drive shaft 146 of the clutch 144, such that the motor 140 may be used to drive rotation of the rotatable drive member 136 when the clutch 144 is engaged. In some embodiments, the rotatable drive member 136 may be carried by the drive trolley 134. Optionally, a rotatable idler 138 may also be carried by the drive trolley 134. The motor 140, clutch 144, drive trolley 134, and rotatable drive member 136 may be supported by a drive mechanism support member 148, which may be attached to the movable partition 102 at or near the leading end or lead post 116 of the movable partition 102, such that the drive system 130 may drive movement of the movable partition 102 along the track 113. In other words, the motor 140 and the clutch 144 may be carried by the movable partition 102.

Optionally, an additional support trolley 124 also may be coupled to the drive mechanism support member 148 for providing additional structural support to the drive system 130. The additional support trolley 124 may comprise support trolley rollers 125 (e.g., wheels), and may be configured to roll along the track 113 at least partially within the channel 123 extending longitudinally through the elongated central guide member 114.

As can be seen in FIG. 4, the drive mechanism support member 148 may be attached near or at the top of the lead post 116. The lead post 116 may further be attached to a lead post attachment bracket 160. A diagonal bar attachment bracket 162 may be attached to the drive mechanism support member 148. A first end of a diagonal bar 164 may be attached to the diagonal bar attachment bracket 162, and a second, opposite end of the diagonal bar 164 may be attached to the lead post 116. Thus, the lead post 116, the drive mechanism support member 148, and the diagonal bar 164 may form a triangular frame that provides structural support to the drive system 130 and couples the drive system 130 to the movable partition 102. Furthermore, some embodiments may include a clutch support member 155 and at least one motor support member 154, which may be attached to the drive mechanism support member 148, to which the clutch 144 and motor 140 may be fastened, respectively. The drive mechanism support member 148 may be carried by the drive trolley 134, and, optionally, by the additional support trolley 124. In other words, the motor 140 and the clutch 144 may hang from the drive trolley 134 (and the optional additional support trolley 124). In other embodiments, the clutch 144 and the motor 140 may be attached directly to the drive mechanism support member 148, the lead post 116, the lead post attachment bracket 160, the drive trolley 134, and/or any other support member coupled with the movable partition 102.

The drive system 130 may further include an alignment member 120, which may be coupled to the drive trolley 134 and configured to limit the movement of the drive trolley 134 and the movable partition 102 in a lateral direction relative to the length of the track 113. The alignment member 120 may comprise a roller (e.g., a wheel). In other embodiments, the alignment member 120 may be or include a rigid or rotatable post. The alignment member 120 may be located on the trolley 134 so as to abut against and roll along surfaces 112 of the elongated central guide member 114 along a slot leading to the channel 123 that extends longitudinally through the central guide member 114, as can be seen in FIG. 2. In other words, when the movable partition 102 is moved along the track 113, the alignment member 120 may abut against and roll along one of the opposing channel surfaces 112 if the movable partition is urged to one lateral side or the other, thus keeping the trolley 134 and movable partition 102 generally aligned with the center of the track 113. In other embodiments, one or more support trolley alignment members 121 may be provided on an additional support trolley 124 in a similar fashion, as shown in FIG. 4.

Referring again to FIG. 3, the first processor 135 may also be installed within the space 122 between the first sheet 102A and the second sheet 102B adjacent the lead post 116. An embodiment of such a first processor 135 is described in detail in U.S. Pat. No. 6,662,848, which issued on Dec. 16, 2003 and is entitled "Automatic Door and Method of Operating Same," the disclosure of which is incorporated herein in its entirety by this reference. Briefly, the first processor 135 may be electrically coupled to one or more input devices and/or one or more output devices such as, for example, sensors, switches, actuators, and indicators. More specific examples of such input and output devices may include: a sensor for detecting when the door is in a closed state; a sensor for detecting when an obstruction is in the path of the door while the door is closing; a switch or actuator used to stop the door from closing, or to open the door for a predetermined time period when already closed; an actuator causing a latch to lock the door in a closed position; a switch or actuator associated with security access (e.g., keyed entry or card readers); and/or indicators such as a horn or an LED display indicating the current status of the door. The first processor 135 may also be coupled with the drive system 130 for selectively controlling the drive system 130 and, hence, the movement and position of the movable partition 102. The first processor 135 may be in bi-directional communication with the electronic component box 137, as described in greater detail below via an electronic signal carrying conduit (e.g., one or more electrically conductive wires or cables), such as a digital bus 141. While the first processor 135 is illustrated herein as being near the lead post 116 of the movable partition 102, in additional embodiments, the first processor 135 may be located elsewhere within the movable partition 102, such as near a floating door jamb 117 (discussed in more detail hereinafter).

Figure 5:
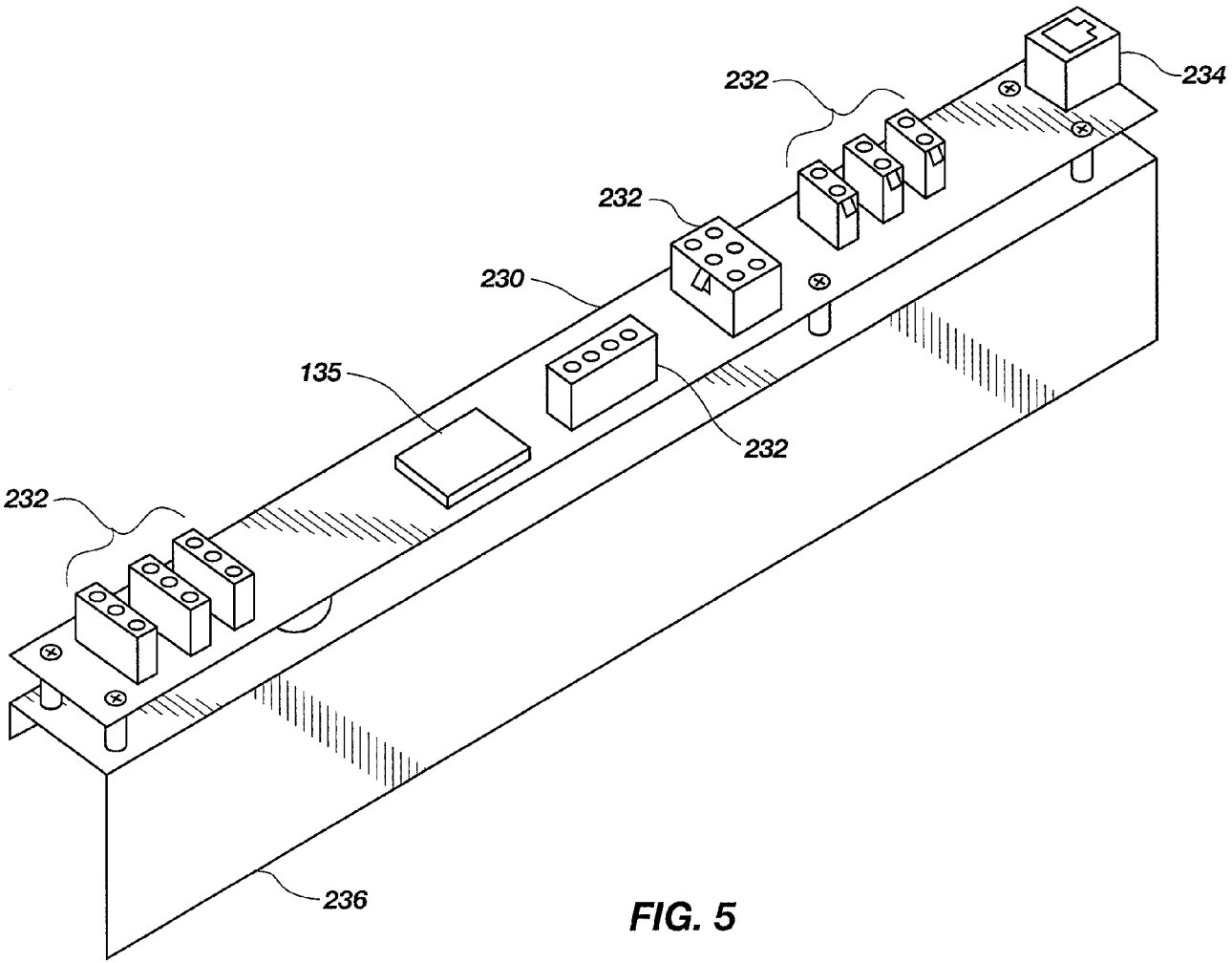
FIG. 5 is an enlarged partial view of a processor of the movable partition system of FIG. 1.

Referring now to FIG. 5, the first processor 135 may be structurally and electrically coupled to a circuit board 230, which may be mounted to a bracket 236. The circuit board 230 includes a number of connectors 232 for electrically coupling the first processor 135 with input and/or output devices. Another connector 234 of the circuit board 230 may be configured for coupling the digital bus 141 (FIG. 3) to the first processor 135 through the circuit board 230. The connector 234 may be configured for transferring both data and power through the digital bus 141. The bracket 236 (with the circuit board 230 mounted thereto) may be mounted to the lead post 116. Alternatively, the bracket 236 may be mounted to the diagonal bar 164 (FIG. 4), or another component of the movable partition 102 or the drive system 130. In additional embodiments, the bracket 236 may be omitted and the circuit board 230 may be mounted directly to the lead post 116, the diagonal bar 164, or another component of the movable partition 102 or the drive system 130.

Figure 7:
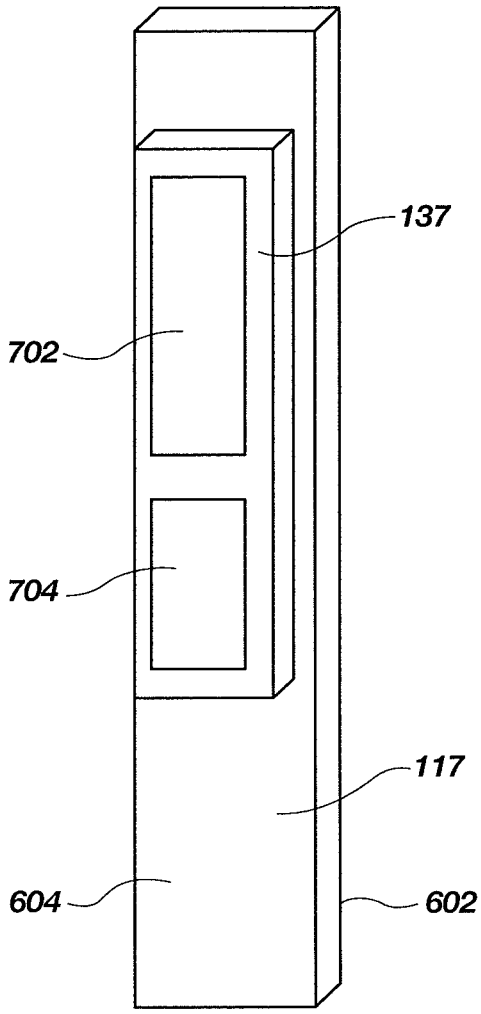
FIG. 7 is another perspective view of the floating door jamb of the movable partition system of FIG. 1.

Referring again to FIG. 3, an electronic component box 137 (which also may be referred to as an electronic component unit) may be installed within the space 122 between the first sheet 102A and the second sheet 102B proximate to (e.g., adjacent) a floating (e.g., sliding) door jamb 117. The floating door jamb 117 may be located within the pocket 108 opposite the lead post 116, and is "floating" in the sense that it is not fixedly attached to the back wall within the pocket 108, and can float (e.g., slide) or move within the pocket 108, although it may not be moved out from the pocket 108 during normal operation of the movable partition system 100. The electronic component box 137 may include one or more of a power supply device, one or more electronic signal processor devices, one or more electronic memory devices, etc. As shown in FIG. 7, the electronic component box includes a power supply 704 and a processor 702. The power supply 704 may comprise a battery-backed power supply as described in detail in U.S. Pat. No. 7,656,129, which issued on Feb. 2, 2010 and is entitled "Methods and Apparatuses for Battery-Backed Power Supply and Battery Charging." Briefly, the power supply may comprise a battery-backed power supply that includes a power converter with an alternating current (AC) input and a direct current (DC) output. A first diode is operably coupled in a forward biased configuration between the DC output and a biased DC output. A supply switch is configured for selectively coupling the biased DC output to a supply output, such that the DC output can be monitored for acceptable power converter operation in-situ. A battery switch is configured for selectively coupling the supply output to a battery-charge signal, and a battery is operably coupled between a ground and a battery output. A current sensor is operably coupled in series between the battery-charge signal and the battery output. A second diode is operably coupled between the battery output and the supply output. A controller is configured for charging the battery by controlling the battery switch with a pulse-width modulation operation and configured for controlling the supply switch to cause the selective coupling between the biased DC output and the supply output. The processor 702 may be configured to control the power supply 704. For example, the processor 702 may signal the power supply 704 to charge. The processor 702 may also control distribution of the power generated by the power supply 704. While the electronic component box 137 is illustrated herein as proximate to the floating door jamb 117 of the movable partition 102, in additional embodiments, the electronic component box 137 may be located elsewhere within the movable partition 102, such as near the lead post 116.

Figure 6:
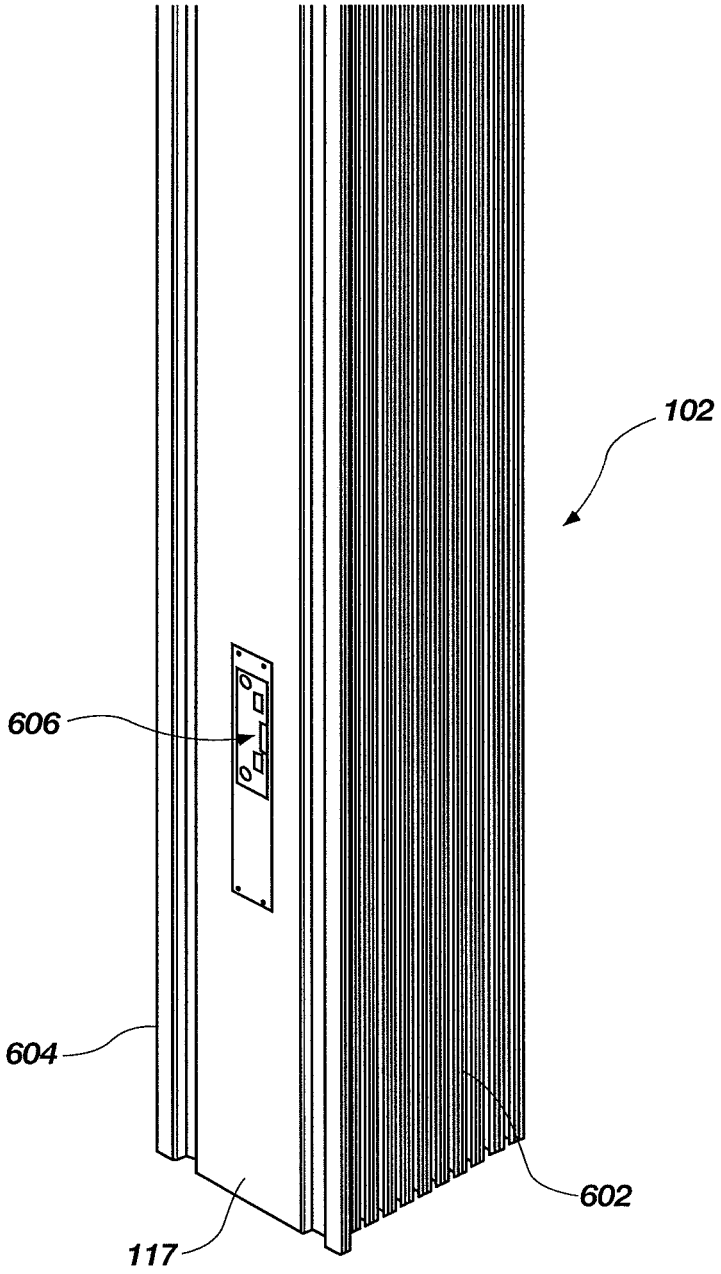
FIG. 6 is a perspective view of a floating door jamb of the movable partition system of FIG. 1.

The electronic component box 137 may be mounted directly to a first side 604 of the floating door jamb 117 between the first sheet 102A and the second sheet 102B. FIG. 6 illustrates a second side 602 of the floating door jamb 117, which is opposite the first side 604 and may face the wall 110A within the pocket 118 (FIG. 3). As shown in FIG. 6, the floating door jamb 117 includes at least one conduit 606 or connector extending through the floating door jamb 117. The at least one conduit 606 provides a means to electrically connect the electronic component box 137 to the building power supply and/or to another electrical system installed within the building. For example, the electronic component box 137 may be connected to at least one of a power supply system and alarm and signal wires located on or in the wall 110A.

By mounting the electronic component box 137 to the first side 604 of the floating door jamb 117, the electronic component box 137 may be safely accessed for servicing. For example, the floating door jamb 117 may be manually or automatically pulled out of the pocket 108 to provide a clear working space for access to the electronic component box 137. This allows the electronic component box 137 to be serviced and in compliance with the National Electric Code (NEC) standards without the need for special permission that is often required when the electronic component box 137 is mounted to the wall 110A within the pocket 108. Similarly, mounting the drive system 130 and the first processor 135 within the movable partition 102 near the lead post 116 provides easy access to the drive system 130 and the first processor 135 for installation and maintenance.

Mounting the drive system 130, the first processor 135 and the electronic component box 137 within the movable partition 102 may also decrease the depth of the pocket 108 in the building. Conventionally, the pocket 108 must have a depth sized to hold the drive system 130, the electronic component box 137, and the retracted movable partition 102. However, by mounting the drive system 130, the first processor 135 and the electronic component box 137 within the movable partition 102, the pocket 108 may have a depth sized only to hold the retracted movable partition 102. Additionally, mounting the electronic component box 137 to the first side 604 of the floating door jamb 117 may provide additional air circulation and cooling to the electronic component box 137. This may allow for more high power use of the electronic component box 137 without the risk of overheating.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A movable partition system comprising:

a movable partition coupled to and movable along a track, the movable partition comprising at least two accordion folding sheets of panels, each of the at least two accordion folding sheets of panels extending between a leading end of the movable partition and a floating door jamb of the movable partition;

a motor carried between the at least two accordion folding sheets of panels of the movable partition and coupled to one of the leading end and the floating door jamb of the movable partition; and at least one electronic component unit comprising a power supply and a processor, the at least one electronic component unit configured to control operation of the motor, the at least one electronic component unit being disposed between the at least two accordion folding sheets of panels and coupled to the other of the leading end and the floating door jamb of the movable partition.

2. The movable partition system of claim 1, wherein the at least one electronic component unit is coupled directly to the floating door jamb.

3. The movable partition system of claim 1, further comprising at least one electrical conduit extending through the floating door jamb and configured for electrically coupling the at least one electronic component unit to an electrical circuit outside the movable partition.

4. The movable partition system of claim 1, wherein the power supply comprises a battery-backed power supply.

5. The movable partition system of claim 1, further comprising at least another processor carried by the movable partition.

6. The movable partition system of claim 5, wherein the at least another processor is located proximate the leading end of the movable partition.

7. The movable partition system of claim 5, wherein the motor is configured to actuate responsive to an electrical signal generated by the at least another processor.

8. The movable partition system of claim 5, further comprising an electrical bus extending between and electrically coupling the processor and the at least another processor.

9. The movable partition system of claim 1, wherein the motor is coupled to the leading end of the movable partition.

10. The movable partition system of claim 9, wherein the motor is coupled to the leading end of the movable partition through a drive mechanism support member attached to the leading end of the movable partition.

11. A movable partition system, comprising:

a track;

a movable partition coupled to the track and extending longitudinally between a first end and a second end, the movable partition comprising:

a first sheet of panels having a first end and a second end;

a second sheet of panels having a first end and a second end, the second sheet of panels being laterally spaced from the first sheet of panels;

a lead post coupled with the first end of the first sheet of panels and the first end of the second sheet of panels; and a floating door jamb coupled with the second end of the first sheet of panels and the second end of the second sheet of panels;

a first processor carried between the first sheet of panels and the second sheet of panels of the movable partition;

an electronic component box carried between the first sheet of panels and the second sheet of panels of the movable partition and coupled to one of the floating door jamb and the lead post, the electronic component box comprising:

a second processor; and a battery-backed power supply; and a motor carried between the first sheet of panels and the second sheet of panels of the movable partition, coupled to the other of the floating door jamb and the lead post, and operably coupled to drive movement of the movable partition along the track.

12. The movable partition system of claim 11, wherein the electronic component box is coupled to the floating door jamb and the motor is coupled to the lead post.

13. The movable partition system of claim 11, wherein the first processor is configured to actuate the motor with an electrical signal.

14. The movable partition of claim 11, wherein the second processor is configured to control the power from the battery-backed power supply.

15. The movable partition of claim 11, wherein the floating door jamb is configured to be flush with a wall of a building.

16. The movable partition of claim 11, further comprising at least one conduit through the floating door jamb.

17. The movable partition of claim 16, further comprising at least one of a power supply and a signal extending from a building to the electronic component box through the conduit in the floating door jamb.

18. The movable partition system of claim 12, wherein the electronic component box is coupled directly to the floating door jamb.

19. The movable partition system of claim 11, wherein the first processor is coupled to the floating door jamb.

20. A method of installing a movable partition system, comprising:

attaching at least one track to an overhead structure of a building, the at least one track extending across a space within the building;

suspending a movable partition from the track, the movable partition comprising a first sheet of panels and a second sheet of panels each extending between a leading end and a floating door jamb, the leading end movable along the track and the floating door jamb movable within a pocket formed in a wall of the building and located opposite the leading end;

coupling a drive system to the movable partition such that the drive system is carried between the first sheet of panels and the second sheet of panels, the drive system configured to move the movable partition along the at least one track;

coupling a first processor to the movable partition such that the first processor is carried between the first sheet of panels and the second sheet of panels proximate the leading end of the movable partition; and coupling an electronic component box directly to the floating door jamb of the movable partition between the first sheet of panels and the second sheet of panels.

21. The method of claim 20, further comprising electrically coupling at least one component within the electronic component box to an electrical circuit outside the movable partition through a conduit extending through the floating door jamb.

22. The method of claim 20, further comprising electrically coupling at least one component within the electronic component box to the first processor.

23. The method of claim 20, further comprising electrically coupling the first processor to the drive system.

* * * * *